US005801483A

United States Patent [19]

Watanabe et al.

[11] Patent Number: 5,801,483

[45] Date of Patent: Sep. 1, 1998

[54] FLUORESCENT LAMP HAVING VISIBLE AND UV RADIATION

[75] Inventors: Miho Watanabe; Hisashi Honda; Keiji Hatakeyama; Yuichi Sakakiabra; Akiko Saitou, all of Kanagawa-ken, Japan

[73] Assignee: Toshiba Lighting and Technology Corp., Tokyo, Japan

[21] Appl. No.: 608,496

[22] Filed: Feb. 28, 1996

[30] Foreign Application Priority Data

| | | | |
|---|---|---|---|
| Feb. 28, 1995 | [JP] | Japan | 7-40782 |
| Mar. 30, 1995 | [JP] | Japan | 7-73727 |
| Jul. 11, 1995 | [JP] | Japan | 7-175075 |
| Jan. 12, 1996 | [JP] | Japan | 8-4155 |

[51] Int. Cl.[6] ..... H01J 1/62

[52] U.S. Cl. ..... 313/485; 313/487; 313/489

[58] Field of Search ..... 313/485, 487, 313/636, 493, 496

[56] References Cited

U.S. PATENT DOCUMENTS

| | | | |
|---|---|---|---|
| 3,748,518 | 7/1973 | Lewis | 313/489 |
| 4,075,532 | 2/1978 | Piper et al. | 313/487 |
| 4,703,224 | 10/1987 | Rattray et al. | 313/487 |
| 4,967,090 | 10/1990 | Schlitt | 313/487 |
| 5,309,069 | 5/1994 | Sigai et al. | 313/485 |

*Primary Examiner*—Sandra L. O'Shea

*Assistant Examiner*—Joseph Williams

*Attorney, Agent, or Firm*—Cushman Darby & Cushman IP Group of Pillsbury Madison & Sutro LLP

[57] ABSTRACT

A fluorescent lamp includes a light-transmitting envelope, means for generating a discharge within envelope, a discharge sustaining fill contained in envelope for emitting ultraviolet rays during the lamp operation and a phosphor layer coated on an inner surface of envelope. The phosphor layer converts the ultraviolet rays into visible light and ultraviolet radiation within a wavelength range of 320 nm to 410 nm so as to have radiant flux ratio of ultraviolet radiation of 5 to 50 percent of the entire radiant flux of the lamp.

22 Claims, 6 Drawing Sheets

FLUORESCENT LAMP HAVING VISIBLE AND UV RADIATION

BACKGROUND OF THE INVENTION

1. Field of the Invention

The present invention relates to a fluorescent lamp which emits visible light and is also suitable for exciting a photo catalytic material.

2. Description of the Related Art

Recently, photo catalytic materials, which are activated by receiving ultraviolet rays, have been researched for various purposes.

One known photo catalytic material is titan oxide. Titan oxide is a semiconductor having a forbidden band width of about 3.0 eV. Electron and hole mobilization occur in the titan oxide when it absorbs ultraviolet rays having sufficient energy to cause an excited state. When energized holes move on a surface thereof. The hole attracts an electron of a material on the surface to oxidize it. The hole has energy to extract an electron from the material which corresponds to the energy of the forbidden band width. The titan oxide can be used as a deodorizer and also used as a catalyzer to decompose a source of bad smell, such as acetaldehyde, methy-methylation-butane, hydrogen-sulfide ammonia and so on. It can also be utilized as a sterilizer in sewage disposal plants, hospitals and other places.

Japanese Laid Open Patent Application No. 1-169866 discloses an ultraviolet lamp having a layer of titan oxide coated on the outer surface of the lamp. The bulb of the lamp is made of quartz glass so as to directly transmit a resonance line of mercury at 254 nm plus small additions of other ultraviolet lines such as 185 nm. The titan oxide layer operates as a photo catalytic layer due to a catalytic reaction that occurs when the titan oxide receives ultraviolet radiation. However, the lamp disclosed in the application is not able to radiate visible light.

It is possible to modify such an ultraviolet lamp into a conventional fluorescent lamp by coating a phosphor layer on the inner surface of the lamp to generate visible light. A conventional fluorescent lamp emits little ultraviolet radiation due to the spectrum of mercury vapor at 365 nm, which is able to excite the photo catalytic material. However, the intensity of the ultraviolet radiation is not sufficient to excite a catalytic material and the lamp is not able to oxidize materials on the surface thereof.

International laid open patent application No. WO 94/11092 and Japanese laid open patent application No. 7-11104 disclose an air treating method using a photocatalyst under interior illumination. According to those applications, the photo catalytic material is excited by ultraviolet radiation from a conventional fluorescent lamp. However, as mentioned above, the intensity of the ultraviolet radiation from a conventional fluorescent lamp is not sufficient to excite the catalytic material.

Special lamps, disclosed in Japanese laid open patent application No. 60-160554 emit both visible and ultraviolet radiation. The phosphor layer of the lamps is mixed with some luminescent compounds so as to radiate visible light and ultraviolet radiation in the range of 280 nm to 310 nm. However, the ultraviolet radiation between 280 nm and 310 nm is classified as UV-b (sunburn region), which causes problems such as an ultraviolet eye disease and a sun burn. Therefore, the lamp is not suitable for general illumination.

SUMMARY OF THE INVENTION

Accordingly, a primary object of the invention is to provide a fluorescent lamp that radiates both visible light and ultraviolet radiation that can excite a catalytic material.

A fluorescent lamp according to the invention includes a light-transmitting envelope, means for generating a discharge within envelope, a discharge sustaining fill contained within envelope for emitting ultraviolet rays during lamp operation and a phosphor layer coated on an inner surface of envelope. The phosphor layer converts the ultraviolet rays emitted by the fill into visible light and ultraviolet radiation in the range of 320 nm to 410 nm. The ultraviolet radiation emitted by the lamp constitutes 5–50 percent of the entire radiant flux of the lamp.

The present invention also provides a lighting apparatus including the fluorescent lamp described above and a photo catalytic layer provided within an area illuminated by the fluorescent lamp.

These and other aspects of the invention are further described in the following drawings and detailed description of the invention.

BRIEF DESCRIPTION OF THE DRAWINGS

The invention will be described in more detail below in conjunction with the following drawings of which.

DETAILED DESCRIPTION OF THE PRESENTLY PREFERRED EXEMPLARY EMBODIMENTS

Figure 1:
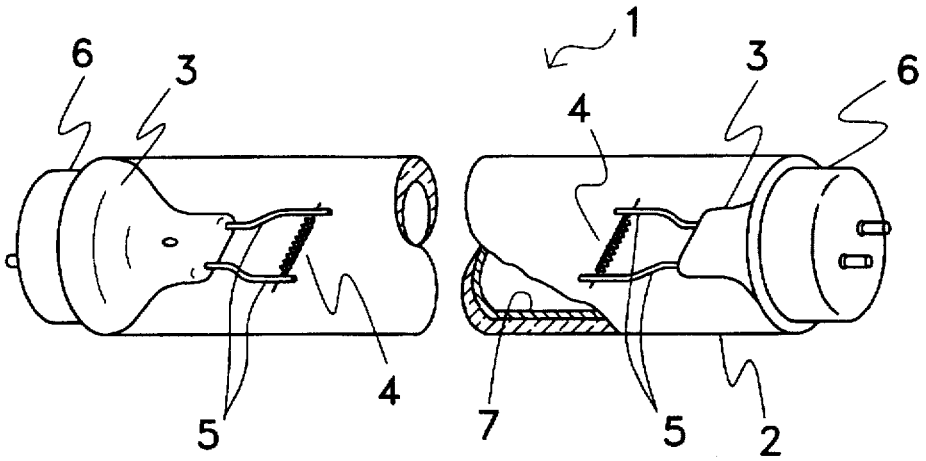
FIG. 1 is a perspective and broken away view of a fluorescent lamp according to a first embodiment of the present invention.

A first embodiment of this invention will be explained with reference to FIGS. 1–6. FIG. 1 shows a fluorescent lamp 1 having a rated power of 37 watts as defined by Japanese Industrial Standard FL40SS. An envelope 2 of lamp 1 is constituted by a straight tube having an outer diameter of about 28 mm and stems 3 sealed into each end of the tube in the customary manner. The tube is made of a soda lime glass which will not pass ultraviolet rays under 300 nm in wavelength. As an alternative, other light-transmitting material can be used for tube, such as fused silica, ceramic, borosilicate glass or glass including more that 500 ppm of ixon oxide.

Each stem 3 supports a pair of electrodes 4 which, during operation, generate a discharge therebetween. Each electrode 4 is formed from a tangustain coiled wire which itself is coiled (double coiled) and employed as a preheating type arrangement. However, other electrode arrangements, such as a cold cathode, an exciting coil for supplying magnetic power to the lamp or an external electrode, may be used. Electrodes 4 are coated with an emitter (not shown) such as BaO, SrO, or CaO, for emitting thermal electrons.

Each stem 3 is provided with an exhaust tube (not shown) that communicates with an opening in the stem wall and has its outer end hermetically sealed after envelope 2 has been evacuated, charged with a discharge sustaining fill, such as mercury vapor, and suitable fill gas in accordance with a standard lamp-manufacturing process. Suitable fill gases are argon, neon, krypton and mixtures thereof.

Each electrode 4 is connected to lead wires 5 which are sealed through the inner end of stem 3 and extend into base 6. Base 6 is cemented to and encloses an end of envelope 2. Each base 6 is provided with a pair of metal pins that are electrically connected to lead wires 5.

A phosphor layer 7 is coated on the inner surface of the envelope 2. Phosphor layer 7 converts ultraviolet rays of 185 nm and 254 nm emitted from a discharge into visible light and ultraviolet radiation in the wavelength range of 320 nm to 410 nm in the UV-aI and UV-aII regions. Phosphor layer 7 is made of a mixture of four luminescent compounds having peak emissions near 610 nm (red light), 540 nm (green light), 450 nm (blue light) and 370 nm (ultraviolet light), respectively.

The luminescent compound emitting red, blue and green are yttrium oxide activated by divalent europium indicated as $Y_2O_3:Eu^{3+}$, barium magnesium aluminate activated by divalent europium indicated as $BaMg_2Al_{16}O_{27}:Eu^{2+}$ and lanthanum ceriumphosphate activated by trivalent terbium indicated as $(La, Ce, Tb)PO_4:Tb^{3+}$, respectively. The luminescent compound emitting ultraviolet radiation is strontia boron oxide activated by divalent europium indicated as $SrB_4O_7:Eu^{2+}$ which has a peak emission at 368 nm. The mixing ratio of the ultraviolet luminescent compound to all of the compounds is selected to be 10 percent by weight. Although in the present embodiment, the ultraviolet luminescent compound is selected to be $SrB_4O_7:Eu^{2+}$, other luminescent compounds may be used. It is preferable to select from the group consisting of alkaline earth metal borate activated by europium, alkaline earth metal silicate activated by lead, alkaline earth metal phosphate activated by europium and rare earth metal phosphate activated by cerium. For instance, those compounds are indicated as $SrB_4O_7:Eu^{2+}$, $(Ba,Sr,Mg)_3Si_2O_7:Pb^{2+}$, $BaSi_2O_5:Pb^{2+}$, $(SrMg)_2P_2O_7:Eu^{2+}$ and $YPO_4:Ce^{3+}$. Furthermore, it is preferably to add halogen to the compound made of alkaline earth metal borate activated by europium in order to intensify its luminous flux. Further, the spectrum of $Ce^{3+}$, including a green luminescent compound indicated as $(La, Ce, Tb)PO_4:Tb^{3+}$, has ultraviolet radiation in the wavelength range of 320 nm to 410 nm, it is also possible to intensify the ultraviolet radiation by increasing the amount of cerium.

Figure 2:
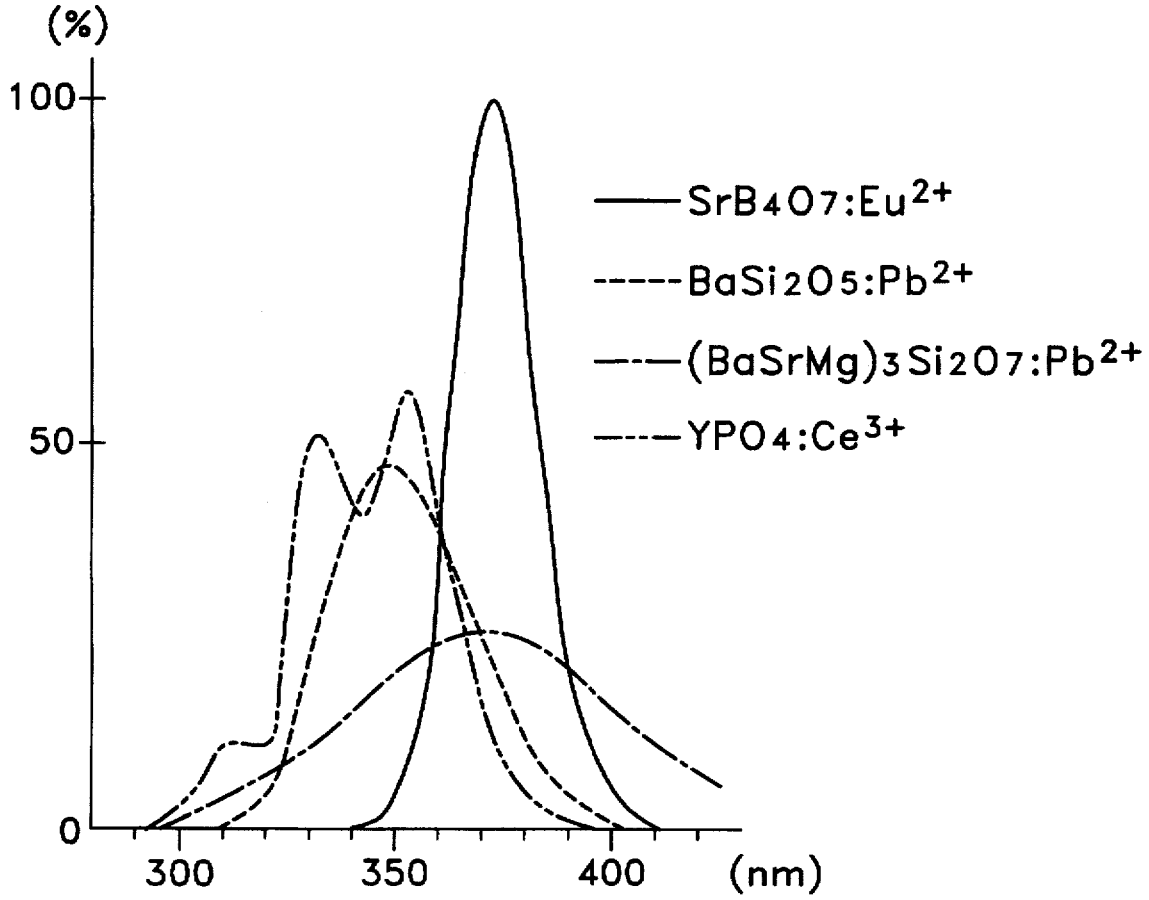
FIG. 2 is a graph showing spectral energy distributions of typical ultraviolet luminescent compounds.

FIG. 2 shows various spectral energy distributions of four typical ultraviolet luminescent compounds. Those compounds radiate ultraviolet rays in the wavelength range of 320 nm to 410 nm.

Figure 3:
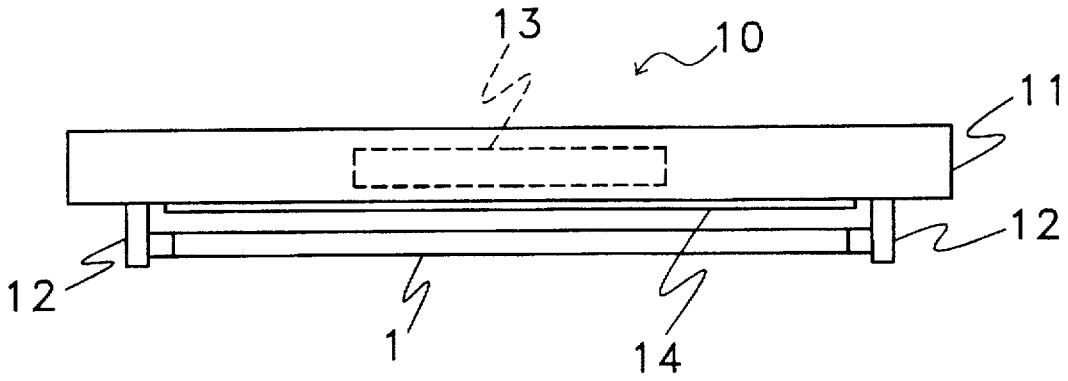
FIG. 3 is a side elevation view of a lighting apparatus using the lamp shown in FIG. 1.

FIG. 3 shows a lighting apparatus 10. Lamp 1 is attached to a luminaire 11 through sockets 12. Luminaire 11 houses an operating circuit 13 for supplying electric power to lamp 1. Operating circuit 13 can be a conventional high frequency inverter circuit or a conventional ballast arrangement, or some equivalent thereof.

A photo catalytic layer 14 of 10 μm thickness is coated on an outer surface of luminaire 11 so as to receive radiation from fluorescent lamp 1. Photo catalytic layer 14 is made of powdered titan oxide which has an average particle diameter of 0.05 μm. The average particle diameter of powdered titan oxide is preferably 1.0 μm or less. Alternatively, other photo catalytic materials, such as zinc oxide (ZnO), cerium oxide ($Ce_2O_3$), terbium oxide ($Tb_2O_3$), magnesium oxide (MgO) or erbium oxide ($Er_2O_3$) may be used. Where, photo catalytic layer 14 can be coated by various methods, such as a conventional dip method, chemical vapor deposition method or any other suitable technique.

As operating circuit 13 generates a lamp current which flows through lamp 1, the discharge generated between a pair of electrodes 4 is extinguished according to the lamp current. The discharge excites mercury vapor which emits ultraviolet rays at wavelengths of 185 nm and 254 nm. The ultraviolet rays are converted into visible light and ultraviolet radiation having a peak at 368 nm by phosphor layer 7 coated on inner surface of envelope 2, then visible light and ultraviolet radiation are radiated through envelope 2.

Figure 4:
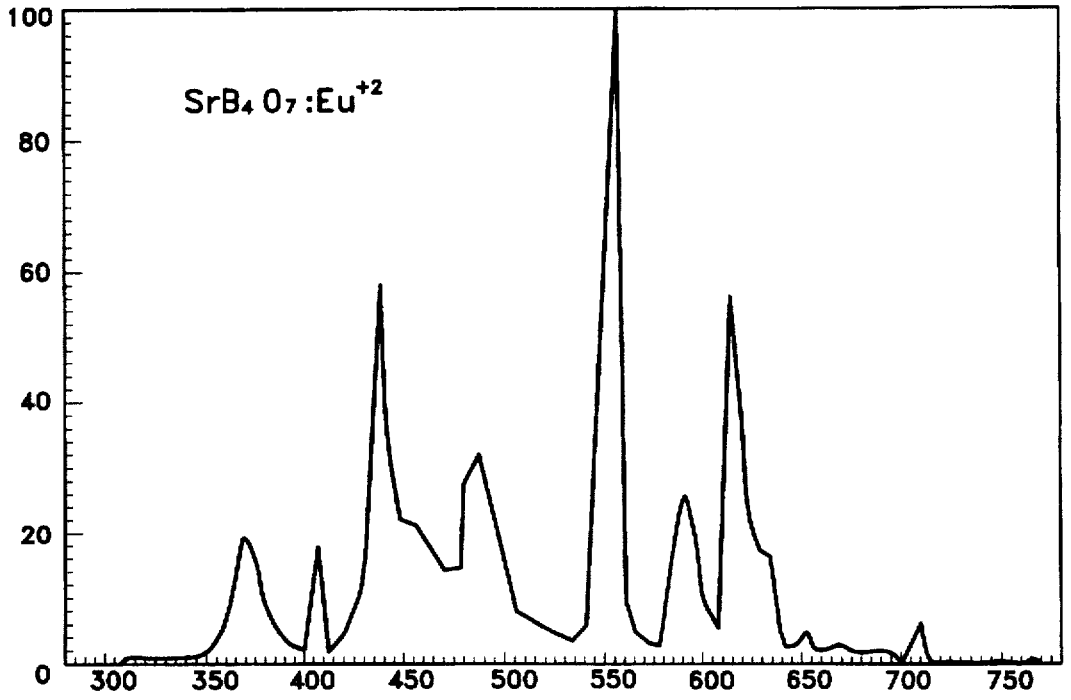
FIG. 4 is a graph showing a spectral energy distribution of the lamp shown in FIG. 1.

FIG. 4 shows a spectral energy distribution of fluorescent lamp 1. As photo catalyst layer 14, coated on luminaire 11, is illuminated by fluorescent lamp 1, it is excited by the ultraviolet radiation it receives. Electron and hole mobilization occurs in photo catalyst layer 14 and holes move on its surface. Materials attached on the surface of photo catalyst layer 14, such as sulfur compounds, nitrogen compounds, aldehydes and so on, are decomposed by a catalysis reaction of photo catalyst layer 14. Therefore, fluorescent lamp 1 is able to excite photo catalyst layer 14 without reducing its visible luminous flux.

Figure 5:
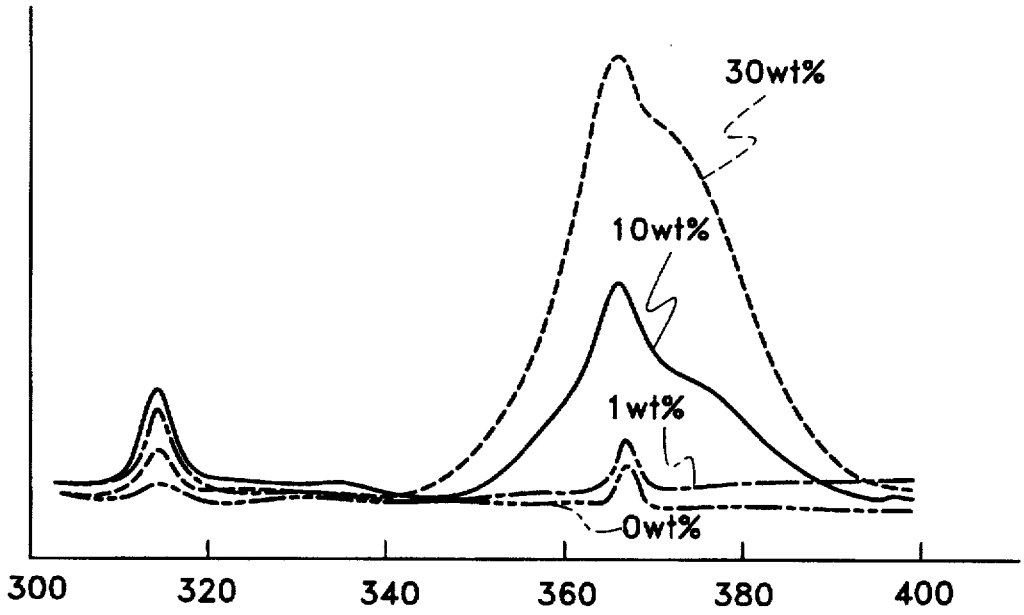
FIG. 5 is a graph showing spectral energy distributions for various ratios of ultraviolet luminescent compounds.

FIG. 5 shows spectral energy distributions of four test samples in the ultraviolet region. The four test samples were made identically except for the compounding ratio of the ultraviolet luminescent compound which is indicated as $SrB_4O_7:Eu^{2+}$. The compounding ratios to whole luminescent compounds of test samples are 0, 1, 10, and 30 percent by weight, respectively.

The luminous flux in the range of 320 nm to 410 nm increases as the compounding ratio increases. Although it is not shown result in detail, when the test lamp has a 30 percent by weight compounding ratio, the radiant flux ratios under 320 nm, within the range of 320 nm to 410 nm, and within the range of 410 nm to 780 nm are nearly 0%, about 15% and about 85%, respectively. Therefore, the test samples have substantially no radiant flux in the UV-b region which causes problems as described above. The method for measuring radiant flux is based on Japanese Industrial Standard No. Z-8724. The radiant flux ratio is found by the integration along the spectrum.

In order to provide a visible luminous flux similar to that of a conventional fluorescent lamp, it is desirable that the radiant flux of the visible light constitute 80% or more of the total radiant flux of a fluorescent lamp having no ultraviolet luminescent compound. For that purpose, the compounding ratio of the ultraviolet luminescent compound should be selected to be 50 percent by weight or less. Furthermore, the ratio is preferably selected to be 10 percent by weight or less in order to maintain visible radiant flux over 85%. However, it is good to maintain the visible radiant flux at least 50% for a lighting source.

Because the spectral luminous efficiency of the light within the wavelength range of 380 nm to 410 nm is low, even if the ultraviolet radiation between 320 nm and 410 nm is mixed within visible light, there is no perceptible color change of illumination from the lamp compared with conventional fluorescent lamps.

Figure 6:
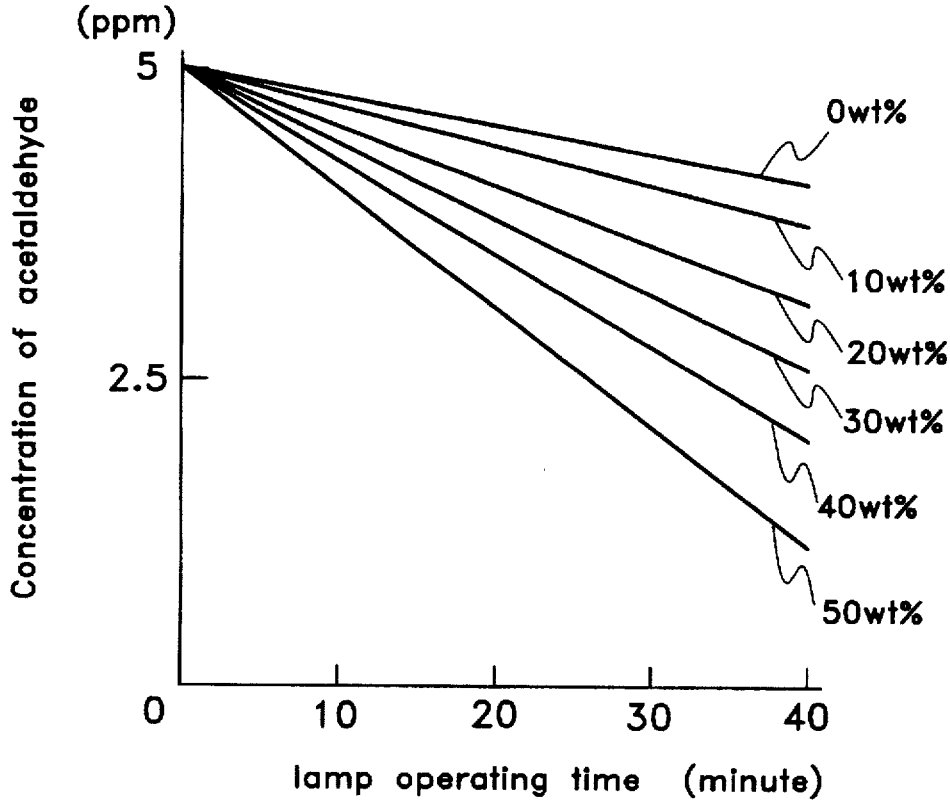
FIG. 6 is a graph showing experimental results relating changes of acetaldehyde concentration to lamp operating times.

FIG. 6 graphs experimental results showing a change of concentration of acetaldehyde in a closed space where test lamps operate near a photo catalyst layer. Each test lamp is made identical to the others except for the compounding ratio of the ultraviolet luminescent compound. The test lamps have luminescent compound emitting ultraviolet radiation ratios of 0, 10, 20, 30, 40, and 50 percent to the whole of the luminescent compounds, respectively.

The concentration of acetaldehyde reduces according to the length of time the lamp operates. However, sharp drops occur when the ratio of the compound increases. Thus, it is necessary to increase the ratio in order to intensify the catalytic reaction of the photo catalyst layer.

Although results are not shown in detail, it is confirmed that the test lamps also enable the decomposition of ammonia in a similar fashion. However, decomposition of ammonia is not always accelerated in proportion to the compounding ratio of the ultraviolet luminescent compound. In other words, it is efficient to use a small compounding ratio of ultraviolet luminescent compound in order to decompose a small source of bad smell. It is known that the concentration of a source of bad smell, such as acetaldehyde and ammonia, is generally less than 10 ppm in a living space. To decompose such a source of bad smell under 10 ppm, the minimum compounding ratio of the ultraviolet luminescent compound is one (1) percent by weight.

Other embodiments in accordance with the present invention will now be explained. Like reference characters designate identical or corresponding elements to those above-disclosed with respect to the first embodiment. The construction and operation of the following embodiment are substantially the same as those of the first embodiment and, therefore, detailed explanations of operations are not provided.

Figure 7:
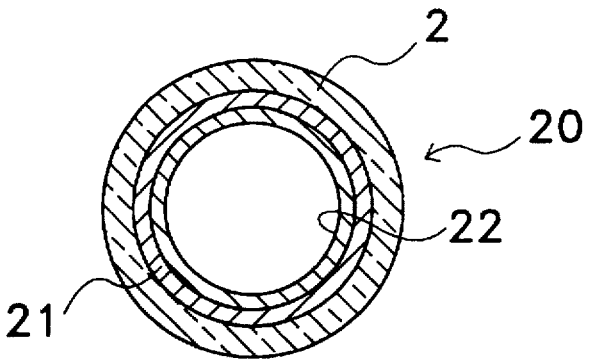
FIG. 7 is a cross sectional view of a fluorescent lamp according to second embodiment of the present invention.

FIG. 7 shows a fluorescent lamp 20 according to second embodiment of the present invention. Lamp 20 has first and second phosphor layers 21, 22 which emit visible light and ultraviolet radiation, respectively. First phosphor layer 21, coated on an inner surface of an envelope 2, is made of an ultraviolet luminescent compound, as mentioned above. Second phosphor layer 22 is coated on first phosphor layer 21 and made of a mixture of three luminescent compounds as described above with respect to the first embodiment. As an alternative, it is possible to provide the second phosphor layer 22 directly on the inner surface of envelope 2. However, in such arrangement, the first phosphor layer 21 is prone to deterioration, because the first phosphor layer 21 directly receives the ultraviolet rays of 185 nm or 254 nm. Therefore, first phosphor layer 21 is preferably provided on an inner surface of envelope 2.

In the present embodiment, ultraviolet rays of 185 nm and 254 nm radiated by the discharge are almost all converted into visible light by second phosphor layer 22. Remaining ultraviolet rays which pass through second phosphor layer 22 are converted into ultraviolet radiation in the range of 320 nm to 410 nm by first phosphor layer 21.

Table I shows luminous flux and radiant ratio of ultraviolet radiation in the wavelength range of 320 nm to 410 nm for five test lamps. A first test sample has the first phosphor layer of 20 μm and the second phosphor layer of 30 μm. Similarly, the second to fourth test samples have first and second phosphor layer thickness described in Table I, respectively. The fifth test sample has a single phosphor layer of 30 μm which is made of mixture of visible luminescent compounds and ultraviolet luminescent compound.

TABLE I

| Sample | Thickness of phosphor layer | | Luminous | Ratio |
|---|---|---|---|---|
| Number | First layer | Second layer | flux (lm) | UV (%) |
| 1 | 20 μm | 30 μm | 2100 | 3 |
| 2 | 20 μm | 20 μm | 2070 | 8 |
| 3 | 20 μm | 15 μm | 2050 | 10 |
| 4 | 30 μm | 20 μm | 2070 | 8 |
| 5 | 30 μm | | 1800 | 10 |

As shown by the data set forth in Table I, when the phosphor layer is formed in two layer, the lamp has high luminous flux without reducing the intensity of ultraviolet radiation in the wavelength range of 320 nm to 420 nm. Accordingly, in the present embodiment, the luminous flux of lamp 20 becomes high.

Furthermore, when metal oxide powder is mixed into the first phosphor layer 21 in amount of 10 percent by weight or more, the first phosphor layer 21 mixed with metal oxide operates as a protective layer which prevent mercury from permeating into envelope 2. Whereby, it is enable to improve lumen maintenance factor and color redition of lamp 20. The metal oxide powder is preferably selected to be aluminum oxide powder ($Al_2O_3$) or silicon oxide powder ($SiO_2$), which have an average particle diameter of 0.1 μm or less.

The thickness of first and second phosphor layers 21, 22 are preferably selected to be within the range of 2 μm to 30 μm and 15 μm to 35 μm, respectively. When the thickness of first phosphor layer 21 is less the 2 μm, the ultraviolet radiation becomes low. On the other hand, when the thickness of first phosphor layer 21 is more than 5 μm, absorbed visible light by first phosphor layer 21, which is radiated from second phosphor layer 22, becomes conspicuous. When the thickness of second phosphor layer 22 is below 15 μm, the visible luminescent flux becomes low. While when the thickness of second phosphor layer 22 is over 35 μm, the attainable ultraviolet radiation to the first phosphor layer 21 reduces.

Furthermore, first phosphor layer 21 preferably has greater transmissivity than that of second phosphor layer 22. If first phosphor layer 21 has a low transmissivity, the visible light tends to be absorbed by first phosphor layer 21 and the visible luminous flux of lamp 20 becomes low. If first phosphor layer 21 has a high transmissivity, the ultraviolet radiation at 365 nm, which is the spectrum of mercury vapor, tends to transmit through first phosphor layer 21 and the intensity of ultraviolet radiation in the range of 320 nm to 410 nm is increased.

Figure 8:
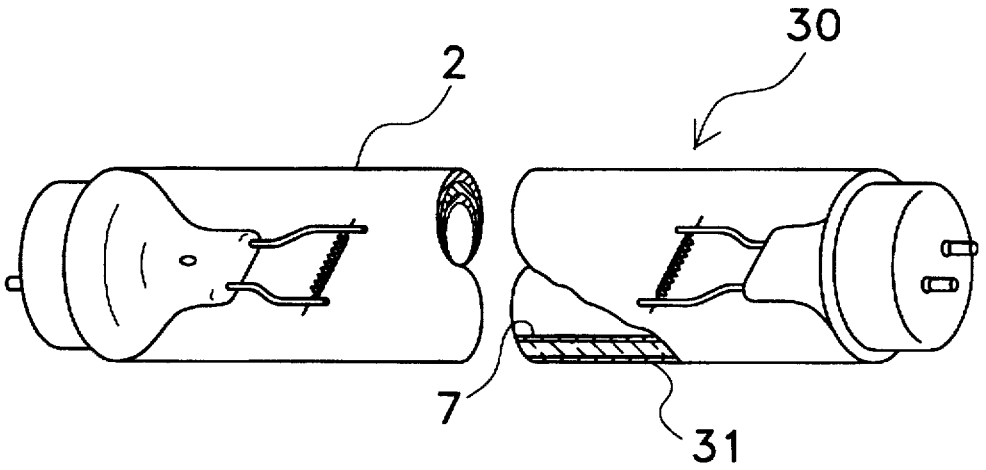
FIG. 8 is a perspective view and broken away view of a fluorescent lamp according to a third embodiment of the present invention.

FIG. 8 shows a fluorescent lamp 30 according to a third embodiment of the present invention. In this embodiment, a photo catalytic layer 31 of 10 μm thickness is coated on an outer surface of envelope 2. Photo catalytic layer 31 is made of powdered titan oxide, which functions as catalyst when it receives ultraviolet radiation. Other constructions of lamp 30 are the same as described above with respect to the first embodiment.

When the lamp operates, ultraviolet rays emitted by mercury vapor are converted into visible light and ultraviolet radiation by phosphor layer 7. The visible light transmits through envelope 2 and photo catalyst layer 31, and the ultraviolet radiation transmitted through envelope 2 is absorbed by photo catalyst layer 31. Electron and hole mobilization occurs within photo catalyst layer 31, and holes move to a surface thereof. Materials attached on the surface of photo catalyst layer 31, such as sulfur compounds, nitrogen compounds and aldehydes and so on, are decomposed due to a catalysis reaction of photo catalyst layer 31. Therefore, lamp 30 is able to deodorize such a source of bad smell. Furthermore, lamp 30 has a disinfecting action against various germs and a purification effect. Accordingly, lamp 30 in the present embodiment has the catalytic reaction without reducing the visible luminous flux. Lamp 30 can decompose materials attached on the surface of envelope 2. As a result, lamp 30 also avoids reducing visible luminous flux, because a photo catalyst layer 31 prevents dust, nicotine or oil stains from accumulating on envelope 2.

Figure 9:
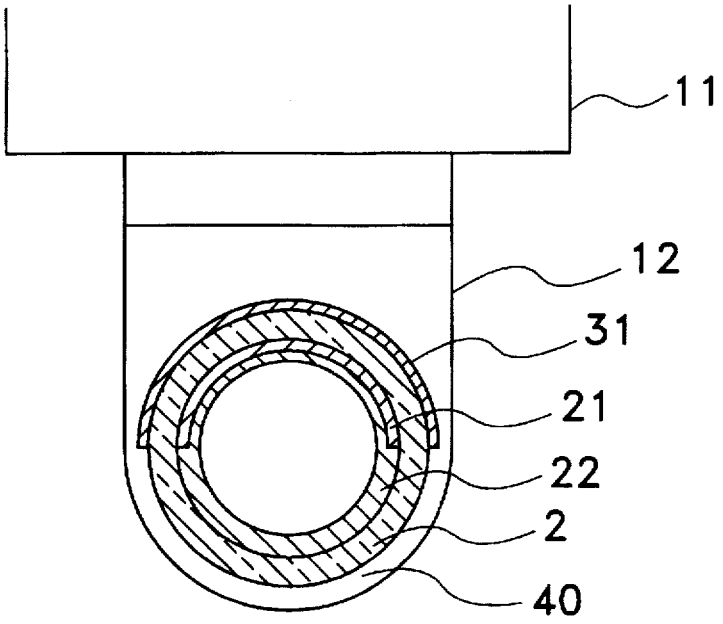
FIG. 9 is a cross sectional view of a fluorescent lamp according to fourth embodiment of the present invention.

FIG. 9 shows a fluorescent lamp 40 according to a fourth embodiment of the present invention and a luminaire 11. Similar to second embodiment, lamp 40 has first and second phosphor layers 21, 22. First phosphor layer 21 is partly coated on inner surface of envelope 21. Second phosphor layer 22 is also coated on first phosphor layer 21 over the whole inner surface of envelope 2. Photo catalyst layer 31 is partly coated on an external surface of envelope 2 corresponding to the area of first phosphor layer 21. According to the present embodiment, lamp 40 has directional qualities. The visible light is efficiently provided toward lower side in this FIG. 9. This gives lamp 40 an advantage when lamp 40 is arranged in luminaire 11 arranged in such a way as to correspond with its directional qualities.

Figure 10:
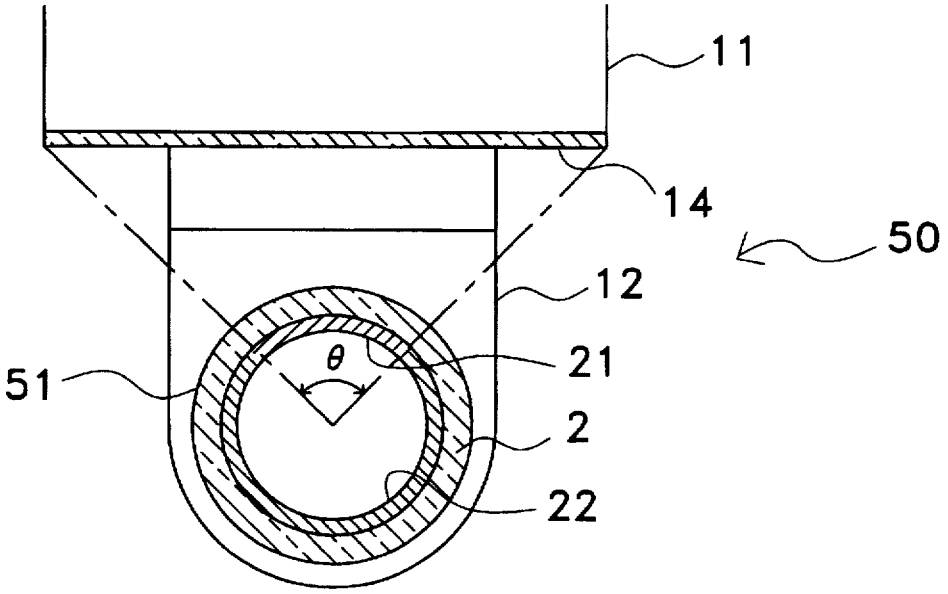
FIG. 10 is a cross sectional view of a lighting apparatus according to fifth embodiment of the present invention.

FIG. 10 shows a lighting apparatus 50 according to fifth embodiment of the present invention. Lamp 51 is partly formed with a first phosphor layer 21 which emits ultraviolet radiation on an inner surface of envelope 2 shown in the upper portion of FIG. 10. In this embodiment, first phosphor layer 21 is coated on the area defined by an angle of 90 degree to the central axis of envelope 2. A second phosphor layer 22 which emits visible light is coated on remaining inner surface of envelope 2. A surface of luminaire 11, which is in the face of upper side of lamp 51, is coated with photo catalyst layer 14 for receiving ultraviolet radiation radiated by first phosphor layer 21.

Figure 11:
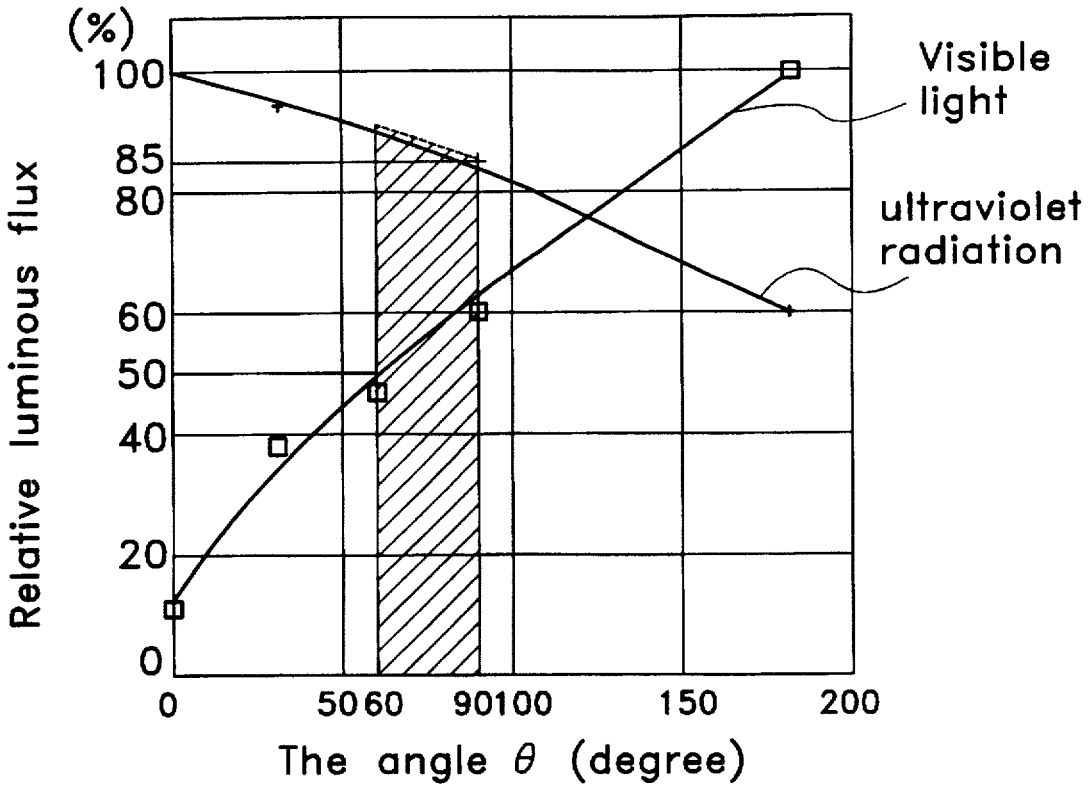
FIG. 11 is a graph showing experimental results relating a change of relative luminous flux to the area of ultraviolet luminous compound.

FIG. 11 shows experimental relating relative visible and ultraviolet flux to the angle θ defining a surface area that is coated. Each test sample has a rated power of 37 watts as defined by Japanese Industrial Standard FL40SS, and an envelope having an outer diameter and a length of 28 mm and 1198 mm, respectively. The first phosphor layer of each test sample is made of $SrB_4O_7:Eu^{2+}$. Each test sample is made identical to the rest except for the angle θ.

As shown in FIG. 11, the visible luminous flux is decreases as the angle θ increases. The visible luminous flux becomes less than 85% when the angle θ exceeds 90 degrees. The ultraviolet radiation increases as to the angle θ increases. In order to intensify the relative ultraviolet radiation over 50%, the angle θ should be selected to be 60 degrees or more. Accordingly, the angle θ is preferably selected to be between 60 degrees and 90 degrees which is indicated as the shadowed portion in FIG. 11.

Figure 12:
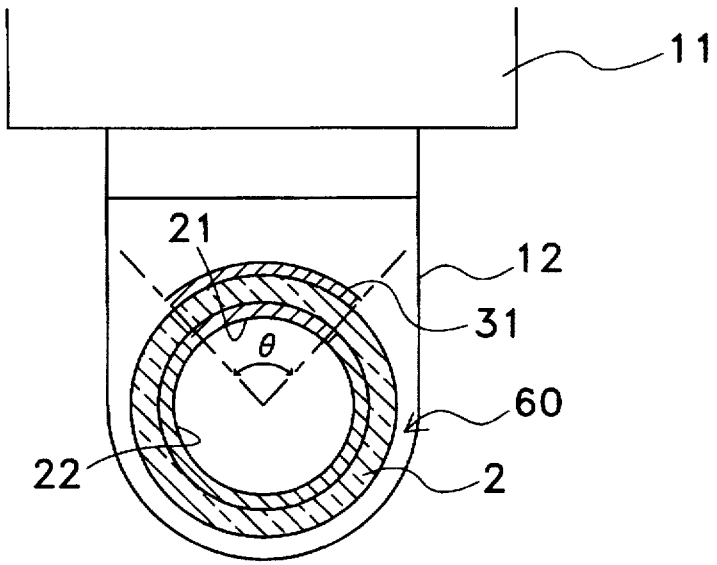
FIG. 12 is a cross sectional view of a fluorescent lamp according to sixth embodiment of the present invention.

FIG. 12 shows a fluorescent lamp 60 according to a sixth embodiment of the present invention and a luminaire 11. In this embodiment, first phosphor layer 21 is partly coated on the inner surface of envelope 21 and second phosphor layer 22 is coated on the remaining inner surface of envelope 2. Photo catalyst layer 31 is partly coated on an external surface of envelope 2 corresponding to the area of first phosphor layer 21.

While the invention has been described in connection with what are presently considered to be the most practical and preferred embodiments, it is to be understood that the invention is not limited to the disclosed embodiments. On the contrary, it is intended to cover various modifications and equivalent arrangements included within the sprit and scope of the appended claims.

What is claimed is:

1. A fluorescent lamp comprising:

a light-transmitting envelope;

means for generating a discharge within the envelope;

a discharge sustaining fill contained in the envelope for emitting ultraviolet rays during the lamp operation;

a phosphor layer coated on an inner surface of the envelope, the phosphor layer converting the ultraviolet rays into visible light and ultraviolet radiation only in a wavelength range of 320 nm to 410 nm so as to have radiant flux of ultraviolet radiation that is 5 to 50 percent of the entire radiant flux of the lamp.

2. A fluorescent lamp according to the claim 1, wherein the fluorescent lamp has an ultraviolet radiation flux that is 10 to 20 percent of the entire radiant flux of the lamp.

3. A fluorescent lamp comprising:

a light-transmitting envelope;

means for generating a discharge within the envelope;

a discharge sustaining fill contained in the envelope for emitting ultraviolet rays during the lamp operation;

a phosphor layer coated on an inner surface of the envelope, the phosphor layer including at least two luminescent compounds emitting visible light and ultraviolet radiation only in a wavelength range of 320 nm to 410 nm, respectively.

4. A fluorescent lamp according to claim 3, wherein the phosphor layer has a compounding ratio of the luminescent compound emitting ultraviolet radiation of 1–50% by weight.

5. A fluorescent lamp according to claim 3, wherein the phosphor layer has a compounding ratio of the luminescent compound emitting ultraviolet radiation of 5–20% by weight.

6. A fluorescent lamp according to claim 3, wherein the phosphor layer comprises a first phosphor layer including a luminescent compound emitting ultraviolet radiation and a second phosphor layer including a luminescent compound emitting visible light.

7. A fluorescent lamp according to claim 6, wherein the first phosphor layer is provided on the inner surface of the envelope and the second phosphor layer is provided on the first phosphor layer.

8. A fluorescent lamp according to claim 7, wherein the first phosphor layer has greater transmissivity of visible light than that of second phosphor layer.

9. A fluorescent lamp according to claim 6, wherein the first phosphor layer is partly provided on the inner surface of the envelope.

10. A fluorescent lamp according to claim 9, the first phosphor layer is provided in an area defined by a 60–90 degree angle measured from a central axis of the envelope.

11. A fluorescent lamp according to claim 6, wherein the luminous compound emitting ultraviolet radiation is comprises at least one compound selected from the group consisting of alkaline earth metal borate activated by europium, alkaline earth metal silicate activated by lead, alkaline earth metal phosphate activated by europium, rare earth metal phosphate activated by cerium and a compound added halogen to alkaline earth metal borate activated by europium.

12. A fluorescent lamp according to claim 3, wherein the envelope has a transmissivity of sixty percent or less to light below 320 nm.

13. A fluorescent lamp according to claim 12, wherein the envelope is made of glass including iron oxide of 500 ppm or more.

14. A fluorescent lamp according to claim 1, further comprising a photo catalytic layer coated on outer surface of the envelope.

15. A fluorescent lamp according to claim 3, further comprising a photo catalytic layer coated on the outer surface of the envelope.

16. A fluorescent lamp according to claim 9, further comprising a photo catalytic layer partly coated on outer surface of the envelope, the first phosphor layer being provided on the inner surface corresponding to the photo catalytic layer.

17. A lighting apparatus comprising:

a fluorescent lamp which includes:

a light-transmitting envelope, means for generating a discharge within the envelope, a discharge sustaining fill contained in the envelope for emitting ultraviolet rays during the lamp operation, a phosphor layer coated on an inner surface of the envelope, the phosphor layer converting the ultraviolet rays into visible light and ultraviolet radiation only in a wavelength range of 320 nm to 410 nm so as to have radiant flux ratio of the ultraviolet radiation between 5 and 50 percent of the entire radiant flux of the lamp; and a photo catalytic layer provided within the illumination area of the fluorescent lamp.

18. A lighting apparatus comprising:

a fluorescent lamp which includes:

a light-transmitting envelope, means for generating a discharge within the envelope, a discharge sustaining fill contained in the envelope for emitting ultraviolet rays during the lamp operation, and a phosphor layer coated on an inner surface of the envelope, the phosphor layer including at least two luminescent compounds emitting visible light and ultraviolet radiation only in a wavelength range of 320 nm to 410 nm, respectively; and a photo catalytic layer provided within the illumination area of the fluorescent lamp.

19. A lighting apparatus comprising:

a fluorescent lamp which includes:

a light-transmitting envelope, means for generating a discharge within the envelope, a discharge sustaining fill contained in the envelope for emitting ultraviolet rays during the lamp operation, a phosphor layer coated on an inner surface of the envelope, the phosphor layer converting the ultraviolet rays into visible light and ultraviolet radiation only within a wavelength range of 320 nm to 410 nm so as to have radiant flux of the ultraviolet radiation that is 5 to 50 percent of the entire radiant flux of the lamp;

an operating circuit for supplying electric power to the fluorescent lamp; and a luminaire housing the fluorescent lamp and the operating circuit.

20. A lighting apparatus comprising:

a fluorescent lamp which includes:

a light-transmitting envelope, means for generating a discharge within the envelope, a discharge sustaining fill contained in the envelope for emitting ultraviolet rays during the lamp operation, and a phosphor layer coated on an inner surface of the envelope, the phosphor layer including at least two luminescent compounds emitting visible light and ultraviolet rays only within 320 nm to 410 nm, respectively;

an operating circuit for supplying electric power to the fluorescent lamp; and a luminaire housing the fluorescent lamp and the operating circuit.

21. A lighting apparatus according to claim 19, further comprising a photo catalytic layer provided on the luminaire.

22. A lighting apparatus according to claim 20, further comprising a photo catalytic layer provided on the luminaire.

* * * * *